United States Patent [19]

Dahl et al.

[11] 4,047,676

[45] Sept. 13, 1977

[54] WINDER VIBRATION DAMPENER

[75] Inventors: Carl B. Dahl, Rockton, Ill.; Jere W. Crouse, Beloit, Wis.

[73] Assignee: Beloit Corporation, Beloit, Wis.

[21] Appl. No.: 533,480

[22] Filed: Dec. 17, 1974

[51] Int. Cl.[2] ..... B65H 17/12

[52] U.S. Cl. ..... 242/66; 242/67.1 R; 242/75.2

[58] Field of Search ..... 242/55, 75.2, 65, 66, 242/67.1-67.5, 18 B; 188/1 B; 310/51; 74/574; 248/18, 20-22, 358 R

[56] References Cited

U.S. PATENT DOCUMENTS

| | | | |
|---|---|---|---|
| 1,994,885 | 3/1935 | Florez | 188/1 B |
| 3,353,632 | 11/1967 | Perhach | 188/1 B |
| 3,417,934 | 12/1968 | Palm | 242/55 |
| 3,487,720 | 1/1970 | Dahl | 74/574 |
| 3,602,448 | 8/1971 | Muensterer | 242/55 |
| 3,640,149 | 2/1972 | McLean | 74/574 |
| 3,670,980 | 6/1972 | Mukai et al. | 242/67.1 R |

*Primary Examiner*—Stanley N. Gilreath
*Assistant Examiner*—John M. Jillions
*Attorney, Agent, or Firm*—Hill, Gross, Simpson, Van Santen, Steadman, Chiara & Simpson

[57] ABSTRACT

A winder or other rotary mechanism having a rotating member subjected to vibrations such as a rider roll for the winder including an energy absorbing vibration damper connected to the rider roll so that defects in a roll being wound due to vibrational engagement of the rider roll with the wound roll are avoided with the dampener including a stationary hollow tube secured along its length to a beam coextensive with the rider roll with a beam member within the stationary tubular member and a resilient hose coiled about the beam and inflated and a plurality of axially extending metal slats between the inflatable tube and the inside of the tubular member laminated with a viscoelastic material for absorbing vibration of the rider roll.

5 Claims, 3 Drawing Figures

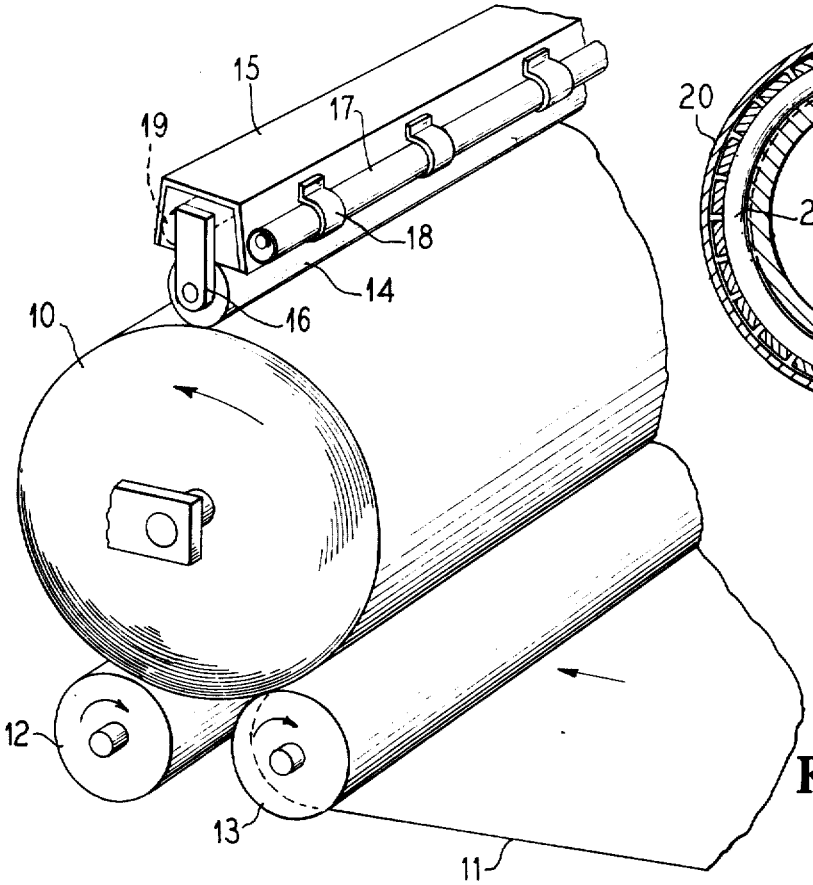
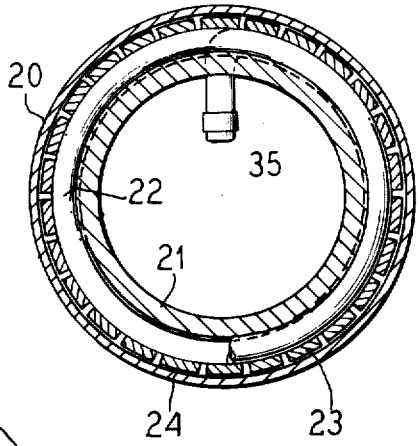
Fig. 3
Fig. 1
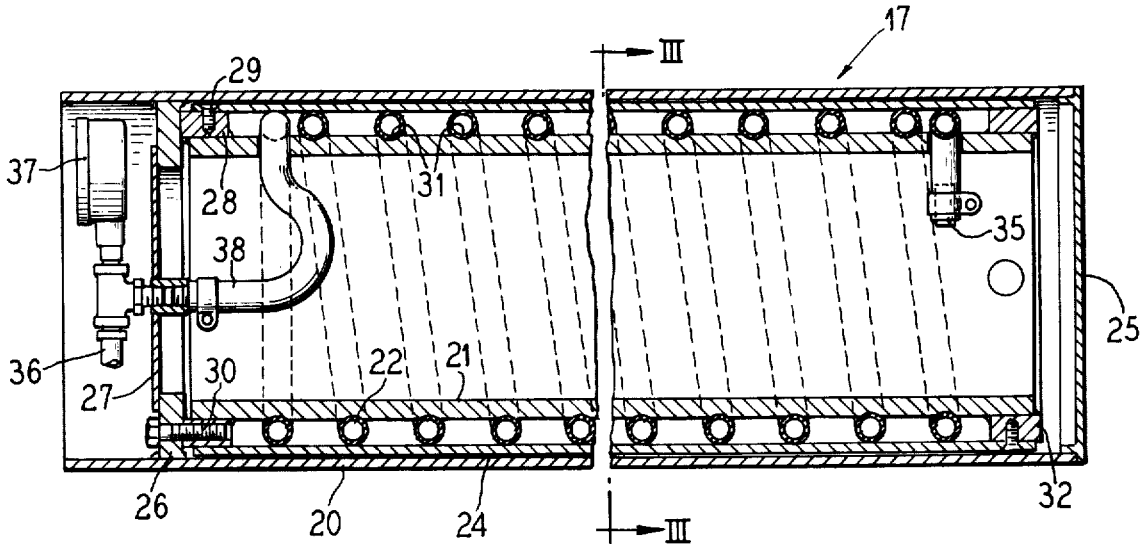
Fig. 2

WINDER VIBRATION DAMPENER

BACKGROUND OF THE INVENTION

The invention relates to improvements in winders for paper making machines and to vibrational dampeners therefor and to improvements in mechanisms for damping the vibrations of various rotating members such as rolls used on a paper making machine.

In a winder for a paper making machine, one type of structures involves a pair of drums on which a paper roll being wound is supported. Above the roll being wound and in engagement with the surface thereof is a rider roll which rests on top of the roll being wound to help control the tension with which the web is wound into the roll and the hardness of the roll. These may be provided for either relieving the weight of the rider roll or for increasing the pressure at which it engages the roll being wound.

During relatively high speed winding operations, the rider roll tends to bounce and vibrate, and this may occur in any type of winding process, such as for paper, plastic, cloth or any continuous web of material. The bouncing and vibration has disturbing effects on the roll being wound in that it causes bumps and ripples and uneven winding and must be eliminated, particularly because its effect is accelerated with increase in winding speeds.

This type of rider roll, and other rolls in the paper making operation, can vibrate at a natural frequency coincident with the degree of freedom represented by the mass-elastic system through a process of self-excitation. Also, its mass-elastic system can have several degrees of freedom, dependent upon the structure thereof, and thus several natural frequencies. The natural frequency of each degree of freedom is also a function of the mass of the winding roll, and in the case of a winder, at a given instant of time during the winding process, and the paper elasticity or spring formed through contact with the rotating roll. It has also been recognized that the rider roll assembly responds to the vibration of the winding itself much like a follower. In order for the assembly to resist the winding roll vibration, it must either be sufficiently stiff, which is impractical in many designs, or it must have its vibrations damped. It is accordingly an object of the present invention to provide a mechanism which is capable of dampening the vibrations in a rider roll and eliminating the defects in the wound roll due to such vibrations.

In accordance with the principles of the present invention, a dampening device is applied to the rider roll wherein the device has an elongate hollow tube which fits into or is attached at one side of a beam which is coextensive with the rider roll. The rider roll is mounted at its ends and bearings on the beam. Within the outer stationary hollow tube or cylinder is an inner beam preferably of circular cross-section and a continuous elastic tubing is annularly or spirally wound around the inner beam. Between the outside of the tubing and and the inner surface of the tubular member is a layer of steel slats which extend parallel to the axis of the beam. To the outer surface of these slats is laminated a sheet of fibrous material. The inflatable tubing is sealed at one end and inflated with a desired air pressure from the opposite end to force the slats outwardly against the inner surface of the cylindrical tube.

This arrangement provides for energy absorption transferred from the beam to the cylinder by the shearing action resulting from the differential strain between the fibrous material and the cylindrical housing when flexural motion occurs, and also from the deformation of the viscoelastic tubing resulting from the inner beam and cylindrical housing having different mode shapes.

The first means of energy absorption referred to above is unique in that it provides the conditions of optimum pressure on the fibrous material, uniform pressure on the fibrous material and no effect of relaxation of the fibrous material.

The second means of energy absorption referred to above is the application by unique means of the classical auxiliary mass damper theory. This requires that the first natural frequency of the inner beam must be between 80% and 125% of the responding frequency of the rider roll beam. Since the responding frequency of the rider roll beam is the function of the mass-elastic system degrees of freedom, thus a function of the winding roll in contact with the winder drums and rider roll, the natural frequency of the inner beam must be designed to encompass a specific frequency range which, in turn, is a function of the mass ratio between the inner beam and rider roll assembly. The mass of the inner being from 2.5% to 12.5% of the mass of the rider roll assembly. The combined assembly of the vibration dampener, which includes the inner beam, wound tubing and slats, is that it provides adequate dampening over a wide frequency range. This damping means may be adjusted to optimum damping conditions by changing air pressure in the tubing. The vibration damper is proportioned along the length of the rider roll assembly in manner such that increments of length subjected to the largest amplitudes of vibration will be subjected to the largest damping forces, creating a damping means quite frictional in nature. Thus, this damping means is expected to be responsive mainly to vibration amplitude and, therefore, somewhat frequency independent.

It is, therefore, a further object of the present invention to provide an improved roll assembly and frequency dampener in a combination which is not complicated in structure and which is capable of operation over a wide range of speeds and can be utilized in a variety of locations in a paper making machine or other machinery having vibration creating rolls.

Other objects, advantages and features will become more apparent, along with equivalent structures which are intended to be covered herein, in the teaching of the principles of the invention in connection with the disclosure of the preferred embodiment in the specification, claims and drawings, in which:

DESCRIPTION OF THE DRAWINGS

FIG. 1 is a perspective view of a winder assembly provided with a rider roll dampening mechanism constructed and operating in accordance with the principles of the present invention;

FIG. 2 is vertical sectional view of the dampening mechanism employed in FIG. 1; and FIG. 3 is a vertical sectional view taken substantially along line III—III of FIG. 2.

DESCRIPTION

FIG. 1 illustrates somewhat schematically a paper web winder of the type commonly used in the paper industry and known as a double drum winder. The winder receives a traveling web 11 which threads over one of two supporting drums 12 and 13 and which carry the winding roll 10. The roll is started on a core and riding on top of the roll is a rider roll 14. The rider roll will be supported in bearings 16 at the end and will be provided with ancillary mechanism, not shown, for either increasing or decreasing the downward force of the rider roll 14 against the wound roll 10.

In operation the winder will travel at relatively high web speeds, which can be in the range of 3,000 feet to 8,000 feet per minute, and vibration and self-excitation at these high speeds can cause impacts between the rolls and particularly nonuniform force between the rider roll and the roll being wound so as to adversely affect the uniformity of the winding. For supporting the rider roll in its position and carrying the end bearings 16, a beam 15 extends for the length of the rider roll. To dampen the vibrations, a vibration dampener 17 is secured along the length of the beam. The dampener is shown secured with clamps which rigidly hold it to the beam 15, and the clamps are at evenly spaced locations. A preferred structure will position the dampener 17 inside the beam at the dotted line location 19. However, in existing structures, a dampener such as 17 can be attached to the outer surface, and it is preferably located at the side of the beam facing the oncoming web of paper, that is, facing the direction of rotation of the roll 10. The length of the dampener is preferably the same as the length of the beam or substantially as long, but it can be constructed to be shorter than the beam. If a dampener of less length is used, it should be centrally located relative to the beam length.

The dampener is shown in greater detail in FIGS. 2 and 3 and includes an outer hollow damping tube 20. The dampening tube has a cylindrically shaped smooth interior, and extending coaxially within the dampening tube is an inner beam 21 which is preferably hollow and cylindrical in shape. The beam is movable within the outer tube for energy absorption, and surrounding the beam is a helically wound inflatable hose or tube 22. The tube rests in a helically shaped groove or seat 31 on the outer surface of the inner beam 21.

A plurality of parallel, preferably axially extending steel slats 23 are positioned sequentially around the circumference of the beam just outside of the inflatable tubing 22 and just within the inner surface of the outer tube 20. The slats are spaced from each other, and preferably have a layer of rubber or rubber-like elastic material 24 laminated to the surface thereof, which material faces and engages the inner wall of the outer tube. The slats may also be laminated with paper felt or other suitable energy absorption material. In some installations, paper will provide better results than rubber insofar as reducing the amplification of the frequency of vibration. The energy absorption takes places in part by the shearing action occurring between the slats and the outer tube. Where the slats are covered with an energy absorption material, the differential strain between the slats and tube provides energy absorption as relative deformation takes place. Further energy absorption occurs in the deformation of the viscoelastic inflatable tubing due to the fact that the inner beam 21 and the outer cylindrical tube 20 have different mode shapes. Energy absorption due to the inflatable tubing is controllable by varying the inflation pressure, and for this purpose, one end of the tubing is plugged as at 35, and the other end of the tubing 38 is connected to inflating mechanism 36. The inflating mechanism is provided with a pressure gauge 37 for indicating to the operator the pressure within the tubing. The inflating mechanism is centrally located and supported on a circular plate 27 which is bolted at its edges to an annular ring 26 which is welded within the outer tube. The other end of the tube is closed by tight fitted circular end plate 25.

At each end, the inner beam carries an annular ring 28 and 32. These rings are drilled and tapped at their ends and bolts such as 29 secure the slats to the rings. The rings are similarly held by bolts to the ends of the tube, but are free of radial attachment so that they can move radially during the energy absorption process. The inner beam 21 may be designed for the correct weight or additional weight may be added, such that the natural frequency may be between 80% to 125% inclusive of the responding frequency of the rider roll beam 15. The responding frequency of the rider roll beam is a function of the mass-elastic system degrees of freedom, thus a function of the winding roll in contact with the winder drums and rider roll. The natural frequency of the inner beam must be designed to encompass a specific frequency range which in turn is a function of the mass ratio between the inner beam and rider roll assembly. The mass of the inner beam is chosen from between 2.5% to 12.5% of the mass of the rider roll assembly. The combined assembly of the vibration dampener which includes the inner beam, tubing and slats, is such that it damps over a wide frequency range, and this can be adjusted to optimum dampening conditions by changing the air pressure. The damping means is responsive mainly to vibration amplitude and is, therefore, generally frequency independent.

The dampener makes it possible to select an optimum pressure between the rider roll, and the roll being wound without concern as to vibrations. Heretofore, when vibrations began occurring, it was necessary to clamp the rider roll down tighter against the roll being wound to eliminate vibrations which had the effect of deforming the roll on the drums. Deflections which then were formed in the roll became essentially prominent, and this created more bouncing and more vibrations, and because of the elastic nature of the roll of paper and because of natural frequencies occurring at certain speeds, destructive vibration and bouncing could occur.

We claim as our invention:

1. A winder for winding a continuous traveling web on a core, comprising in combination:

supporting roll means for supporting a rotating roll being wound; a supporting beam having bearings, an elongate rider roll rotatably mounted on said supporting beam in said bearings above the roll being wound and in rotational contact with the roll;

a vibration absorber secured to said supporting beam and extending parallel to the roll and absorbing energy along the length of the roll generated by radial bouncing movements of the wound roll transmitted to the rider roll and to the supporting beam through said bearings supporting the rider roll on the supporting beam;

said vibration absorber having an axially extending hollow outer cylinder secured to the supporting beam an inner beam member floatingly carried within said outer cylinder;

an inflatable tube surrounding the inner beam member and located between the cylinder and inner beam member;

and an inflation means for controllably inflating the tube against the interior of said outer cylinder.

2. A winder for winding a continuous traveling web on a core constructed in accordance with claim 1:

and including an energy absorption means between the cylinder and tube.

3. A winder for winding a continuous traveling web on a core constructed in accordance with claim 2:

wherein said energy absorption means is in the form of axially extending metal slats.

4. A winder for winding a continuous traveling web on a core constructed in accordance with claim 1:

wherein said cylinder is attached to the supporting beam by axially spaced clamps extending along the supporting beam.

5. A winder for winding a continuous traveling web on a core constructed in accordance with claim 1:

wherein the ratio of the weight of said inner beam member to said rider roll and supporting beam is in the range of 2.5% to 12.5%.

* * * * *